US008851279B1

(12) United States Patent
Husmann

(10) Patent No.: US 8,851,279 B1
(45) Date of Patent: Oct. 7, 2014

(54) PRODUCT MARKETING MAGAZINE RIDER

(71) Applicant: Mark Husmann, Los Angeles, CA (US)

(72) Inventor: Mark Husmann, Los Angeles, CA (US)

(73) Assignee: Fragrance Marketing, LLC, Las Vegas, NV (US)

( * ) Notice: Subject to any disclaimer, the term of this patent is extended or adjusted under 35 U.S.C. 154(b) by 0 days.

(21) Appl. No.: 13/998,372

(22) Filed: Oct. 24, 2013

(51) Int. Cl.
*B65D 73/00* (2006.01)
*B65D 5/42* (2006.01)

(52) U.S. Cl.
CPC ..... *B65D 5/4204* (2013.01)
USPC ..... 206/232; 206/457; 206/459.5; 206/497

(58) Field of Classification Search
USPC ..... 206/214, 223, 232, 457, 459.5, 472, 206/497; 281/29, 34, 35, 36, 45
See application file for complete search history.

(56) References Cited

U.S. PATENT DOCUMENTS

| | | | | |
|---|---|---|---|---|
| 2,330,619 | A * | 9/1943 | Pomeranz | 229/87.05 |
| 2,728,450 | A * | 12/1955 | Haire | 206/459.5 |
| 4,369,882 | A | 1/1983 | Schluger | |
| 4,492,306 | A | 1/1985 | Cooper | |
| 4,925,029 | A | 5/1990 | Friedman et al. | |
| 4,966,285 | A * | 10/1990 | Otake et al. | 206/455 |
| 5,368,333 | A | 11/1994 | Arroyo | |
| 5,397,156 | A * | 3/1995 | Schach et al. | 283/67 |
| 5,716,075 | A * | 2/1998 | Evert, Jr. | 281/31 |
| 6,688,648 | B2 * | 2/2004 | McKinney et al. | 281/12 |
| 6,974,158 | B1 * | 12/2005 | Westcott, Jr. | 281/29 |
| 7,621,402 | B2 | 11/2009 | Sandow | |
| 2002/0195814 | A1 * | 12/2002 | McKinney et al. | 281/29 |
| 2003/0010670 | A1 * | 1/2003 | Dobler | 206/581 |
| 2003/0230501 | A1 * | 12/2003 | Smolev | 206/232 |
| 2007/0193899 | A1 * | 8/2007 | Weber et al. | 206/308.1 |

OTHER PUBLICATIONS

U.S. Appl. No. 12/024,726, filed Feb. 2, 2012, Samplemax Inc.
U.S. Appl. No. 12/025,511, filed Feb. 2, 2013, Samplemax Inc.

* cited by examiner

*Primary Examiner* — Jacob K Ackun
(74) *Attorney, Agent, or Firm* — Thomas W. Cook

(57) ABSTRACT

A publication and product delivery package is disclosed which permits product samples to be packaged and displayed along the binding (or "spine") of a publication, such as a magazine, or an object of similar size, and delivered to a purchaser of that publication utilizing standard delivery services, such as the United States Postal Service, even when such products may be otherwise loose, liquid, or fragile, and despite the stresses and impacts of such packaging, display, and delivery. In a novel marketing method, the publication package allows a product distributor to include additional attractive marketing text and images alongside product sample containers, and coordinated with similar text and images impressed on the delivered product sample containers, to achieve high-impact and memorable promotion with little delivery costs over the cost of delivering the publication alone.

12 Claims, 7 Drawing Sheets

PRODUCT MARKETING MAGAZINE RIDER

TECHNICAL FIELD OF THE INVENTION

The present invention relates generally to a device and method for the packaging and distribution of products. More specifically, the present invention relates to a device and method which permits a variety of products to be packaged and displayed along the binding (or "spine") of a publication, such as a magazine, or an object of similar size. One or multiple products may then be delivered to the purchaser of that publication in an attractive, efficient, cost effective way, utilizing standard delivery services such as the United States Postal Service. The device and method of the present invention allows products which are otherwise loose, liquid, or fragile to survive in their original form, and arrive at the location of the purchaser intact, despite the stresses and impacts of such packaging, display, and delivery.

The device and method of the present invention also allows the product manufacturer or distributor to include other additional attractive marketing text and images alongside product containers, in the same "publication package." These additional text and images achieve a number of purposes, including providing additional exposures of product names graphics. All additional text and images may be coordinated with similar text, images, colors, and overall look and feel of text and images impressed on the delivered products, or on containers which hold the delivered products, all to achieve high-impact and memorable promotion of the products so delivered, with minimal additional delivery costs over those costs of delivering the publication alone.

Product manufacturers devote considerable time and resources to advertising and promoting their products and, more particularly, to giving away sample trial portions of their products for consumers. Consumers may, with such sample trial portions, examine and even use small amounts of such products, and thereby come to an informed decision about the value and desirability of such products. It is, however, difficult to place even sample trial portions of products into the hands of the desired target market along with marketing materials which explain product use and desirability. Direct mail advertising has proven to be an effective means of product promotion, however direct mail advertising is way too costly for most products, even when only samples are used, and direct mail is often perceived as "junk mail." When products are received along with a copy of a prestigious magazine, on the other hand, the association between product and magazine is perceived as an endorsement of the product, and so increases its value to the advertiser and manufacturer.

Incorporating a product sample into a magazine is a common practice, undertaken by product manufacturers to in an effort to join product samples and product advertising. In such cases, the magazine is used as a "vehicle" for delivery of the product of the manufacturer. Product manufacturers and advertisers may also more effectively reach a desired group of potential customers by directing their sample products to select magazine subscribers. In such vehicle magazine product delivery, an advertisement is usually placed within a chosen magazine, accompanied by a usually flat sample of a product such as, for example, a fragrance (this is typically referred to as a "scratch and sniff" advertisement). However, due to the limitations of the design of a magazine, it is generally impractical to include samples having significant three-dimensional or hardened shapes (such as a small shampoo bottle), as such shapes may prevent the vehicle magazine from fully closing, or prevent it from bending, and such three dimensional or hardened shapes are subjected to considerable stress and impact moving through the channels of the standard delivery service.

The present invention is designed to provide a means for distributing sample materials and promotional items efficiently and selectively, therefore providing a more efficient utilization of limited marketing resources, while at the same time protecting such promotional items from breakage. The present invention discloses a product sample holder which is lightweight, inexpensive, and efficient, which is designed to be utilized in conjunction with magazines or publications as a "rider," or a "ride-along" as defined by the United States Postal Service. That is, the durable holder device of the present invention is included in the same publication package with a selected magazine publication, however the holder device has additional components which stabilize it within the publication package, so that it maintains its position along one edge of the magazine.

Magazines which are chosen as vehicle publications for delivery using the holder device of the present invention may therefore have a wide variety of forms, from a generally square, glued binding, or tapered and stapled bindings, or no binding at all. The only shape requirement for the holder device of the present invention is that it have the attributes of a standard publication (typically a magazine), such as a sufficient number of pages to give the publication sufficient rigidity that it will not collapse within the publication package. The design of the holder device of the present invention permits easy insertion of product samples into an outer package container, secure closure of the outer package container by appropriate means, positioning of the outer package container, with backing, close to an issue of the selected magazine, and containment of all components within the product package (i.e., with magazine, outer package container with inner package containers, and backing) by "poly-bagging," or "shrink wrap," or other means. Once the product package has been sealed, the holder device of the present invention is consistent with standard publication delivery methods, such as direct mail, newsstand distribution, and United States Postal Service delivery, and the holder device of the present invention is the first and only methodology for delivery of sample products with magazines which has been tested and approved by the United States Postal Services for such delivery. Product manufacturers may thereby reach their targeted consumers, who will receive their publication with product samples intact. Moreover, the apparatus and methodology of the present invention will not damages postal machinery, or contaminate postal customer mail boxes, carrier bags, and the like, with content leakage. As a result, fluids such as fragrances, which are flammable, loose substances such as glitter, and other materials may be transported, even if they would be considered flammable or hazardous in other containers.

Further, the clear plastic tubing of the preferred embodiment of the outer package container of the present invention allows consumers to easily identify the samples enclosed therein (generally within inner package containers), while the backing to which the outer package container is affixed bears additional marketing text and graphics which are coordinated with the graphics of the inner package containers. With this arrangement of inner package containers within the outer package container, and with this arrangement of attractive marketing materials on the front and the back of the outer package container backing, the product manufacturer achieves a maximum of advertising space with the publication package of the present invention. All of this advertising space is viewable from the back of the publication (on the back of the backing) when in transit, and on the front of the backing when the outer package container is separated from the chosen magazine. All of the advertising appearing on the front and back of the backing is also coordinated with the advertising on the inner product containers (or the products themselves), thereby insuring overall aesthetic appeal of the selected publication, and maximum advertising impact for product manufacturers when a purchaser detaches the outer package container and backing from the selected magazine, and removes product samples for inspection and use.

DISCLOSURE OF INVENTION

Summary of the Invention

Beginning with the main components of the present invention, the holder device of the publication package present invention consists of an outer package container, a backing affixed to the outer package container, and means for securing the outer package container and backing together with a selected publication during transit.

The outer package container of the present invention is formed preferably from clear plastic, so that potential consumers wishing to purchase the selected magazine or one of the products contained within the outer package container may view its contents. The outer package container may be circular in cross section, or generally rectangular (or generally square) or any other cross-sectional shape, so long at the container as a whole forms a tube, within which one or more inner containers may reside. The outer package container material should be resilient enough, and durable enough, to withstand some rough treatment when the selected publication is injected into the hands of standard delivery services, such as the United States Postal Service. As it is within the method of the present invention to utilize such standard delivery services, it is desirable that such services test devices for delivering samples such as the present invention, and the present invention has so been tested, and approved by the United States Postal Service.

The outer package container is also preferably about as long as the selected publication is long. Approximately matching the length of the selected publication and the outer package container is desirable because movement of the outer package container in relation to the selected publication is thereby reduced once the outer package container and the selected publication are "bundled" together within shrink wrap plastic or other means for holding the outer package container to the selected publication. The outer package container is also generally uniform in width along its length, and generally rectangular in cross section, creating thereby a generally uniform tube, into which products or the inner package container of product containers may be inserted. The outer package container is generally closed at one of its ends during manufacture, thereby creating a closed-end tube of clear, durable plastic. However, the outer package container may be left open at each end in some embodiments, and closed by suitable closure means at each end after filling. During manufacture, the outer package container is left open at one of its ends (defined herein as the "top" end), so that the inner package container of the products or product containers may be placed within the outer package container.

The outer package container is also preferably about as thick, when measured perpendicularly to the plane of the magazine, as the selected publication is thick. However, the outer package container may vary in its thickness from the magazine thickness by a variance of one quarter inch, and still remain within U.S. Postal Service regulations. When the outer package container and the selected publication are matched for thickness in this way, the transit through standard delivery services is easier, because the publication package is more uniform in thickness, thereby allowing faster and more uniform handling by the automated equipment of the standard delivery service, and more uniform stacking of publication package as copies of the selected publication are stored before delivery or sale. However, the outer package container and the selected publication need not be precisely matched in thickness in this way, as the automated handling equipment of standard delivery services and the stacking of copies of the selected publication may each accommodate some small variation in thickness between the outer package container and the selected publication. The outer package container of the publication package may therefore accommodate samples and sample containers of a variety of widths, as the inner package container are inserted into the tube of the outer package container.

The outer package container is also supplied with a outer package closure, or formed with a closure, which may be fitted over the remaining open end of the outer package container after the inner package containers containing the products are inserted into the outer package container. A simple means for closure is a plug, which may be fitted within the end of the outer package container, or a cap which may be fitted over the end of the outer package container. In the latter case, some small reduction in outside dimension of the outer package container is desirable to maintain the uniform exterior of the outer package container once inner package containers have been inserted and its open end closed with such a cap.

During manufacture, the outer package container has affixed to it the outer package container "backing." The outer package container backing is formed to fit snugly against the outer package container, and generally along its entire length, once the outer package container and the backing are affixed to one another. The outer package container backing is also formed about as long as the length of the selected publication, and about as wide as the width of the selected publication, including the binding of the selected publication if any. With length and width about the same as the selected publication, the backing may fit against the back of the selected publication in transit (the preferred position generally), or against the front of the selected publication in transit (a potentially good position in some cases). With length and width about the same as the selected publication, the backing will tend to stay in position against the back of the selected publication in transit, so long as the covering means of the publication package of the present invention (more fully explained below) has been put in place, so that the covering means encloses the outer package container and the selected publication.

The backing of the outer package container is also rigid enough to resist folding within the covering means of the publication package of the present invention. Accordingly, once the covering means has been positioned around the selected publication and outer package container (with its backing), the outer package container will tend to remain in its intended position, along one edge of the selected publication, during transit by standard delivery services. Of course, the rigidity of the material from which the backing is made will determine what thickness is required to achieve this result, materials such as card stock and poster board being a bit thicker overall than materials such as rigid plastic, or even metal. Since the backing is intended also be bear advertising, the backing materials should be of a kind which accepts printing consistent with the exterior appearance of the inner package containers. The preferred embodiment of the present invention envisions lightweight cardstock, however all materials from which the backing may be made are within the scope of the present invention.

During manufacture, the backing is also printed with text and graphics which relate to the products to be delivered in the outer package container. To relate to those products, the backing text and graphics are chosen to coordinate with text and graphics found on those products, or on the inner package container which contain those products. This coordination of materials between the backing and the products to be delivered creates a uniform visual commercial impression which, in the preferred embodiment of the present invention runs from the body of the product, through the container which contains that product (generally one of a number of the inner package containers of that product) and, since the inner package containers may be seen through the plastic material from which the outer package container is made, right on to the backing which is attached to the outer package container. And since the backing has two sides, that consistent commercial impression, which may be chosen by the product manufacturer, may occupy space on each side of the backing as large as the area of the back cover or the front cover of the selected publication. On the other hand text and graphics on the back side of the backing may, in some embodiments of the present invention, duplicate the text and graphics on the back cover of the magazine, thereby preserving the advertising value of the back cover, which may already have been purchased by an advertiser.

The publication package covering means is an integral part of the present publication package invention because, as we note above, the covering means maintains the position of the outer package container backing against the back or front of the selected publication once the backing has been placed in one of those positions during the final assembly of the publication package. The covering means is gathered about the selected publication, the backing, and the outer package container so as to hold these components in place, with the edges of the backing approximately matching the position of the edges of the pages of the selected publication. Since the covering means is gathered, somewhat snugly in some embodiments, and since the backing also is affixed to the outer package container, the outer package container is also held in position against the spine of the selected publication so long as the covering means remains. Since the covering means is intended to be removed by a purchaser or consumer, the covering means thus remains in place surrounding the components of the publication package throughout transit by standard delivery means.

The covering means is in one preferred embodiment a thin and clear plastic "poly-bag." In other embodiments, the covering means may be opaque, to hide the front and back covers of the magazine. In yet other embodiments, the thin and clear plastic may be "shrink-wrapped" (shrunk to fit by heat) around the combination of the outer package container (with backing) and the selected publication once these two pieces have been properly positioned one against the other. With such a shrink-wrap covering means, the backing of the outer package container and the back cover of the selected publication (for instance) may be held "in register," so that the outer package container which is affixed to the backing is positioned and held in place along one edge of the selected publication. However, other means of holding two objects such as the outer package container and backing and selected publication may be used, so long as they comply with the requirements imposed by standard delivery service suppliers.

In some embodiments of the present invention, the inner package containers which hold or contain the products to be delivered may fairly be said to be part of the present invention. In such cases, the inner package containers, which are formed to fit within the outer package container of the publication package, are also formed in sizes suitable to each of the products to be delivered in the publication package. The inner package containers are also printed on their exterior, or text and graphics are otherwise impressed on their exterior, suitably for each of the products to be delivered in the publication package. This may be done by the product manufacturer or by the marketing company which supplies the inner package containers to the product manufacturer. The inner package containers may then be delivered by the publisher or marketing company to different product manufacturers for filling, and the publisher or marketing company may separately apply the matching (coordinated) text and graphics to the backing of the outer package containers.

Once the inner package containers have been filled by the manufacturer, and returned to the publisher or marketing company after filling, the inner package containers may then be placed within the outer package containers of the publication package in such a way as the inner package containers containing the product from each product manufacturer is situated within the outer package container so that marketing text and graphics associated with that manufacturer on the exterior of the inner package containers is positioned over and closest to the marketing text and graphics associated with that same manufacturer on the backing of the outer package container. In this way may the text and graphics of any single product manufacturer carry smoothly and consistently through each element of the publication package, from product, to product container (or inner package container, visually through the clear plastic of the outer package container), through the front of the backing (which will be situated against the back cover of the selected publication), and through the back of the backing (which will be visible through the covering means from the back side of the selected publication).

In some sense, then the outer package container, with its backing, and the inner package containers, are all pre-manufactured before their final assembly into the publication package of the present invention. Once they are pre-manufactured, the inner package containers are filled by the manufacturer or the marketing company, and returned to the marketing company or the publisher, which then places each inner package container in its proper position within each outer package container (on-register with the text and graphics of the backing of the outer package container), and closes each outer package container to seal in the inner package containers. The marketing company or the publisher then performs the final assembly of the publication package of the present invention by positioning the backing of each outer package container against the back cover of the selected publication, with the outer package container along one edge of the selected publication, covers the combination outer package container, backing and publication with the clear plastic of the publication package covering means, and applies sufficient heat to "shrink wrap" the outer package container and backing to the selected publication. Once the final assembly of the publication package is completed in this way, the publication packages with enclosed publications may be handled just as any other publication by standard delivery services (for a small additional charge).

Several patents have been directed to the promotion of advertising goods, or to the incorporation of goods within a publication, and so they are prior art. For example, U.S. Pat. No. 1,848,980 to Walker discloses a pencil holder adapted to engage the grooves of the binding of a book. However, Walker requires the use of a semicircular tube open on one side, as opposed to a tube which is totally enclosed, with a hinged latch at one end. As a result, a publication incorporating Walker would be damaged in the event that a liquid sample were to burst inside Walker's holder.

U.S. Pat. No. 4,968,061 to Bullard Jr. discloses an advertising booklet which is adapted to hold a sample of the goods being advertised through a plurality of slots extending partially through the pages. The invention disclosed in Bullard is impractical for use in a magazine for a variety of reasons, particularly when the sample intended to be delivered is a fluid. However, regardless of the form of the sample, the sample cutout of Bullard extend through most of the subject magazine, thereby affecting other text and graphics adversely.

U.S. Pat. No. 5,209,349 to Porter et al. discloses an apparatus for distributing product samples to consumers along with a publication through a display container positioned on the front or back of the publication. The display container in turn is formed with recess windows, in which the sample products are placed, and publication, and the display container, with sample products situated within its recessed windows, is encapsulated with clear plastic in a shrink-wrap process. While the invention of Porter requires shrink-wrapping as in the present invention, the display container of Porter substantially increases the thickness of the magazine, and prevents viewing of the front or back cover of the magazine at a newsstand. Further, should the shrink-wrap of Porter tear, the samples within the display container would be lost.

U.S. Pat. No. 5,716,075 to Evert discloses a device and method for the packaging and distribution of sample products to consumers along with a publication, whereby said product samples are enclosed within product sample holders and inserted into a rectangular tube made of transparent plastic material having at least one planar surface. The planar surface of the rectangular tube is then secured against the square binding of a magazine or publication by means of clear adhesive tape, thereby allowing the product samples to be distributed to magazine subscribers or at newsstands. The invention disclosed in Evert is an advance over prior art in the field of sample delivery by means of subscription publications. In particular, Evert allows the delivery of such samples with a publication without increasing the thickness of the publication, and without obscuring the front or back of the publication. However, the shortcomings of the Evert invention, and three of the large differences between the Evert invention and the present publication package invention, may be found in the means for holding that durable outer tubular container to the publication used for its delivery, and in the character of the tube found in Evert in light of the materials from which it is made. We turn now to these two subjects.

The tape holding means disclosed in Evert necessarily implies some instability in positioning between Evert's tube 20, positioned lengthwise adjacent to the binding of publication 60, using clear adhesive tape 50. As Evert explains, two strips of adhesive tape 50 are applied at opposite ends of tube 20 to properly secure tube 20 in place and to prevent detachment during shipping. However, Evert teaches that the number of strips of adhesive tape 50 which are to be utilized may vary, dependent upon the length and thickness of magazine/publication 60. This leads us to the conclusion that the length, width, or mass of tube 20 may mean instances in which stability between tube 20 and magazine 60 requires more of tape 50 to "properly secure tube 20." Standard delivery services, and even newsstands, also put extraordinary stresses on publications such as magazines during shipment, and mere tape simply cannot provide the stability of the shrink-wrap encapsulation of the present invention. Mere tape also cannot provide the weather and dirt protection of the poly-bag or shrink-wrap encapsulation of the present invention.

Moreover, U.S. Postal rates vary, from inexpensive "book rate" for publications, to much more expensive "first class rate" for "regular" mail. While regular mail may be used for delivery of product samples, mailing at first class rates is very expensive and so, in many instances, cost prohibitive. Book rate, on the other hand, allows publishers and advertisers to utilize the dramatically lower rates established by Congress for publications to deliver product samples, but only if the publisher or advertiser meets U.S. Postal Service regulations for delivery of publications. Evert does not meet such regulations, because the U.S. Postal Service will charge first class rates on publications if any item is attached to such publications. Thus, while the invention of Evert may work for its intended purpose, it is not cost effective. The publication package of the present invention, on the other hand, does not require anything to be attached to the delivered publication, but instead encloses all components in covering means such as poly-bag or shrink-wrap, thereby meeting U.S. Postal Service regulations. As a result, sample products delivered with publications using the device and method of the present invention are delivered at book rates, with a "ride-along" surcharge. This rate allows delivery at dramatically reduced cost.

Evert also discusses "protecting" samples during shipping, but does not say how such samples are protected. In fact, Evert discusses protecting samples during shipping only in the context of its product containers 40 consisting of rectangular cardboard boxes or carded blister pack containers 70. However, cardboard boxes and blister packs are not generally considered durable or resilient of shocks and forces exerted during shipment, and are nothing like the rigid plastic outer package container of the present invention, which is specifically engineered to protect product samples from damage, breakage, and leakage.

Finally, the tape holding means disclosed in Evert also necessarily implies limitations on front and back cover advertizing, advertizing Evert calls "a prime source of advertising revenue." Evert uses clear adhesive tape because such tape prevents the front cover of the magazine from being obscured, thereby preserving the aesthetic newsstand appeal of the publication. Evert also teaches that the tape may easily remove the holder 10 from the magazine 60 by grasping the tube 20 and removing the adhesive tape 50 by the non-adhesive center strip 52 of adhesive tape 50. These, of course, are additional processes necessary to gaining access to the samples Evert intends to deliver, which potentially do not "prevent alteration or modification to the back cover of the magazine," as Evert claims.

A review of the prior art disclosed above indicates that while there have been numerous attempts to devise a means for distributing product samples along with a publication, there remain inherent problems with each one. These devices therefore lack the desired benefit of providing an inexpensive, efficient and standardized means for placing product samples in the hands of magazine subscribers or readers while not adversely affecting the appearance and/or size of the subject publications. The present publication package invention avoids all of these problems, and provides entirely new functionality and marketing capabilities with the additional advertising space located on the backing of the outer package container. More specifically:

1. The backing may be formed of high quality material, most suitable for printing high quality images and texts. If we consider the difference between even slick magazine grade single-page paper, upon which an advertisement may be placed, and hard and smooth card stock used for playing cards, we can appreciate that card stock for playing cards may be handled in ways even high quality magazine grade paper may not. Also, card stock for playing cards may take printing and preservation processes that magazine grade paper may not. As a result, the backing of the present invention may not only be keyed to the outer and inner package containers, but the backing may be printed in ways which create exceptional, one-of-a-kind advertising impact. As a result, advertising images on the backing may have an advertizing impact and advantage over and above even those images usually allocated to the front and back covers of a magazine.

2. Since the outer package container and the backing are first separated from the selected publication, and since the front of the backing is also printed with high quality text and images, the consumer subscriber is exposed to the front of the backing much as she would be exposed to the front of the magazine. In some sense, the front of the backing has even more interest, as the graphics on the front of the backing lead the consumer naturally to the samples to be delivered in the outer package container, and allow the eyes of the consumer to linger over the high impact images on the front of the backing until the consumer can open the outer package container, and remove all inner package containers containing samples. Thus, the front of the backing is exposed separately from the front and back of the magazine, thereby creating a second "front cover" (and a second "back cover"), for multiple images in these highly desirable positions in magazine trade.

The more important features of the invention have thus been outlined, rather broadly, so that the detailed description thereof that follows may be better understood, and in order that the present contribution to the art may be better appreciated. Additional features of specific embodiments of the invention will be described below. However, before explaining preferred embodiments of the invention in detail, it may be noted briefly that the present invention substantially departs from pre-existing apparatus and methods of the prior art. In so doing, the present invention provides publishers with the highly desirable ability to add marketing images and texts to their magazines and, at the same time, provides fragrance manufacturers with the highly desirable ability to deliver samples of their products to targeted potential customers.

OBJECTS OF THE INVENTION

One object of this invention is to provide a holder which may be used for distributing sample products and promotional materials.

Another object of this invention is to provide such a holder that may accompany a magazine or other publication of any size, that is, of any width, length, or thickness.

Another object of the present invention is to provide such a holder adapted for use in distributing sample materials to a selected sample of the public, therefore providing an efficient utilization of marketing resources.

Another object of the present invention is to provide such a product sample holder that may be economically produced in mass quantities.

Another object of the present invention is to provide such a holder that may hold product containers in a variety of lengths, so that different volumes of product may be delivered with such publication, and in which such product containers may be formed to hold fluids intended for delivery, along with sprayers for such fluids.

Another object of the present invention is to provide such a holder that may be used with a variety of publications.

Another object of the present invention is to provide such a holder that may be distributed by a publisher or advertiser with products which are consistent with the theme of the subject publication, and coordinated with its advertising.

Another object of the present invention is to provide such a holder that fits alongside the binding of the publication, or alongside any similar edge of the publication, allowing copies of the publication to be easily stacked without damaging the holder or the publication, and at the same time allow the publication to be folded, or rolled into a tube, and to be inserted in any USPO approved mail box.

Another object of the present invention is to provide such a holder that may be formed of a clear plastic which allows for easy and quick identification of the particular products delivered in the holder, thereby providing both increased impact on potential consumers as well as additional incentive for prospective newsstand customers to purchase the publication.

Another object of the present invention is to provide such a holder that is affixed to a backing having the approximate width and length of the magazine or publication, which backing may be situated against the back or front cover of the magazine, and held in that position by a plastic covering, including a plastic cover which encloses the holder and backing and magazine in a plastic poly-bag or shrink-wrap process, to keep the holder and backing in register position against the back or front cover of the magazine so the holder remains in place along one edge of the magazine or publication.

Another object of the present invention is to provide such a holder, with backing, that may be easily and fully separated from the subject publication without harming the text or artwork on the front cover, the back cover, or the spine.

Another object of the present invention is to provide such a holder of product samples and promotional materials that may act as incentives to purchase the subject publication over other publications on display, therefore increasing the sales of the publication.

Another object of the present invention is to provide such a holder that consists of a fully enclosed, durable and resilient, tube, thereby ensuring excellent protection of the product samples delivered in the holder, as well as an effective means of protecting the products and product containers from tampering.

Another object of the present invention is to provide such a holder having a backing formed of high quality material, most suitable for printing high quality images and texts, which may be keyed to the outer and inner package containers, in ways which create exceptional, one-of-a-kind advertising impact.

Another object of the present invention is to provide such a holder in which the outer package container and the backing are first separated from the selected publication, so that a consumer or subscriber is exposed to the front of the backing much as she would be exposed to the front of the magazine, thereby allowing the graphics on the front of the backing, which are coordinated to the graphics on inner package containers, to lead the consumer naturally to the samples to be delivered in the outer package container, and allowing the eyes of the consumer to linger over the high impact images on the front of the backing until the consumer can open the outer package container, and remove all inner package containers containing samples.

BRIEF DESCRIPTION OF DRAWINGS

The accompanying drawings, which are incorporated in and constitute a part of this specification, illustrate preferred embodiments of the present invention, and such drawings, together with the description set forth herein, serve to explain the principles of the invention.

DETAILED DESCRIPTION OF A FIRST PREFERRED EMBODIMENT

Figure 1:
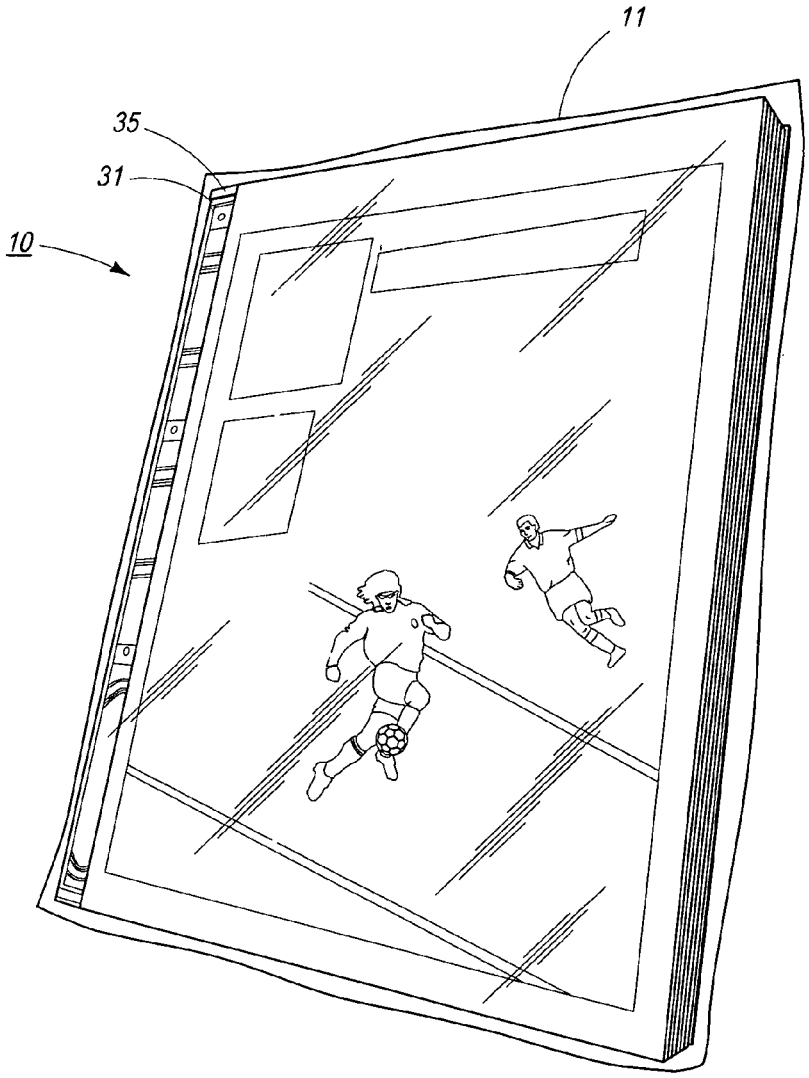
FIG. 1 is a perspective view drawing of a first preferred embodiment of the publication package of the present invention, viewed from the front cover, with publication package poly-bagwrap covering means.

Referring initially to FIG. 1, a first embodiment of publication package 10 of the present invention is shown in perspective, as it has been wrapped in plastic shrink-wrap covering means 11. In FIG. 1, various components of publication package 10 may be viewed through shrink-wrap covering means 11, however those components may not generally be accessed until such time as shrink-wrap covering means 11 is removed from publication package 10. Upon removal of shrink-wrap covering means 11, the consumer may separate the components of publication package 10, and also access the products to be delivered. Until delivery to the consumer is complete, all components are contained within, and protected from dirt and weather by, shrink-wrap covering means 11. In this configuration, publication package 10 may be handled by distributors just as any other publication may be handled, and stacked for storage. In this configuration, shrink-wrap covering means 11 also hold components of publication package 10 together, and in proper "register" one to the other, so that individual copies of the chosen publication may be stacked, and handled just as any other publication, shifting components of publication package 10 within shrink-wrap covering means 11, or adversely affecting their condition. However, even as shrink-wrap covering means 11 protects the contents of publication package 10, and before shrink-wrap covering means 11 is removed, the title of the chosen publication, all of the front cover of that publication, and most other components of publication package 10 contained within shrink-wrap covering means 11 are viewable by distributors and consumers.

Figure 2:
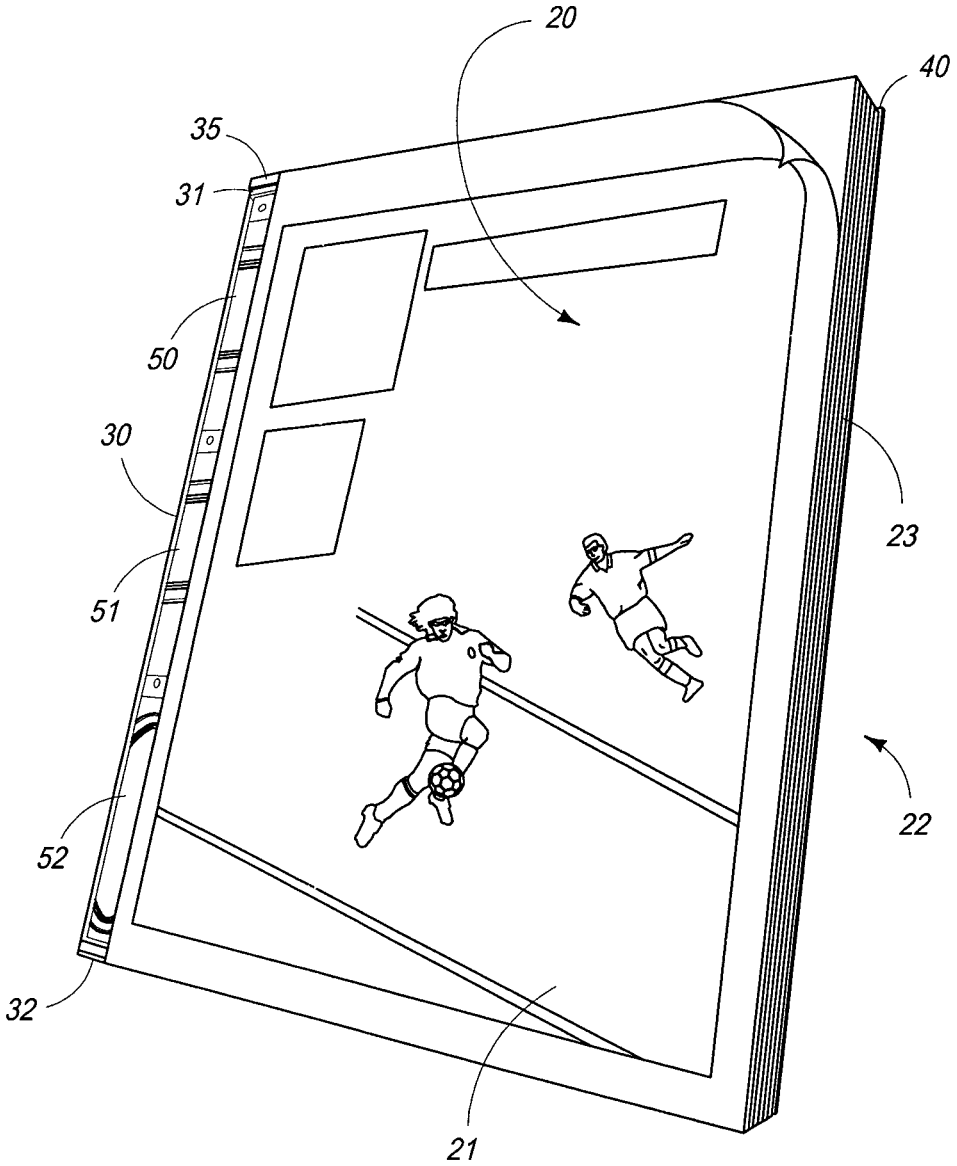
FIG. 2 is a perspective view drawing of a first preferred embodiment of the publication package appearing in FIG. 1, viewed from the publication front cover and page edge sides.

Turning now to FIG. 2, a first embodiment of publication package 10 of the present invention is shown in perspective, and for clarity without shrink-wrap covering means. Thus, publication package 10 may now be appreciated in its condition after deliver to a consumer, and after shrink-wrap 11 has been removed. In FIG. 2, publication package 10 has attached to it selected publication 20, viewed from selected publication 20 front cover 21 side. Selected publication 20 page opening edge 22 may be seen, along with edges of individual pages 23 of selected publication 20. In this case, selected publication 20 is a magazine, however publication package 10 may be utilized to distribute products by accompanying a variety of publications. Outer package container 30 of publication package 10 may also be seen, formed in a regular, tubular shape, with outer package container 30 top end 31 and outer package container 30 bottom end 32. In FIG. 2, a first generally flat side (not shown) of outer package container 30 is positioned against spine edge 24 of selected publication 20. A second generally flat side 34 (shown in FIG. 3) of outer package container 30 is affixed to publication package 10 backing 40 (not fully shown), and backing 40 is positioned against the back cover 25 of selected publication 20. Outer package container 30 is formed of clear plastic in this embodiment, and three (in this embodiment) ipcs, inner package container 50, inner package container 51, and inner package container 52, may be seen through the plastic of outer package container 30. Inner package containers 50 through 52 are positioned snugly within outer package container 30 in such a way that graphics, which may appear on the exterior sides of inner package containers 50 through 52 may be viewed through the clear plastic of outer package container 30. In FIG. 2, we may not see outer package container 30 closure means, however, outer package container closure means resides within or around outer package container 30 top end 31, to close outer package container 30 top end 31 once inner package container 50 through inner package container 52 have been placed within outer package container 30.

Figure 3:
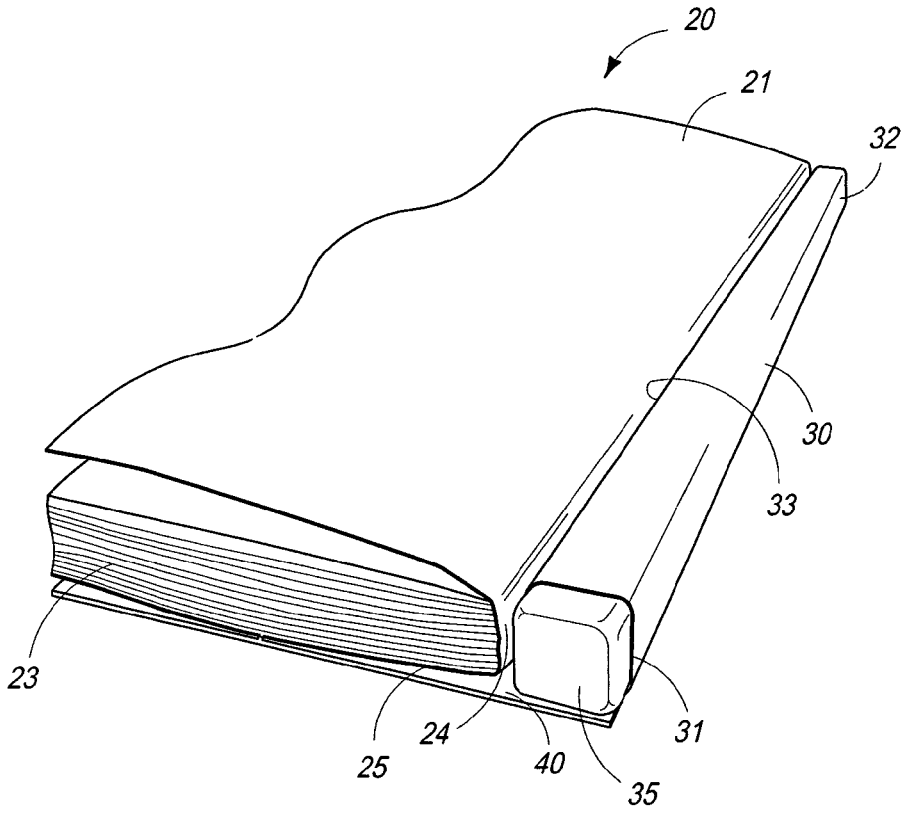
FIG. 3 is a perspective view closeup drawing of the first preferred embodiment of the publication package appearing in FIG. 1, viewed from the front cover and outer package container top end, with outer package container closure means in the form of a plug fitted within the end of the outer package container.

In FIG. 3, only a portion of the first embodiment of publication package 10 of the present invention shown in FIG. 1 appears in perspective, again without shrink-wrap covering means for clarity. That portion of publication package 10 which appears in FIG. 3 is outer package container 30, end-on, from outer package container 30 top end 31. Again in FIG. 3, publication package 10 has attached to it selected publication 20, viewed from selected publication 20 front cover 21 side. Again, the edges of individual pages 23 of selected publication 20 may be seen, and again outer package container 30 of publication package 10 may be seen formed in a regular, tubular shape, with outer package container 30 top end 31 and outer package container 30 bottom end 32. Thus, FIG. 3 shows a portion of publication package 10 as it resides within shrink-wrap 11, and as it appear to a publication purchaser if she removed shrink-wrap 11 from publication package 10, and rotated outer package container 30 and selected publication 20 together to view outer package container 30 from outer package container top end 31. In FIG. 3, first generally flat side 33 of outer package container 30 may be seen positioned against spine edge 24 of selected publication 20. Second generally flat side (not shown) of outer package container 30 is affixed to publication package 10 backing 40, and backing 40 is positioned against back cover 25 of selected publication 20. While outer package container 30 is formed of clear plastic in this embodiment, inner package container 50 through 52 are omitted from FIG. 3 for clarity, along with the shrink-wrap covering means. However, in the normal course inner package container 50 through 52 (in this embodiment; additional inner package containers may be used in other embodiments) reside within outer package container 30 when the publication is in transit, being delivered to a consumer or subscriber in shrink-wrap 11. We may also see outer package container 30 closure means 35 (in this case a plug), fitted snugly within outer package container 30 top end 31, thereby closing outer package container 30 top end 31 with inner package containers 50 through 52 (not shown) residing within outer package container 30.

Figure 4:
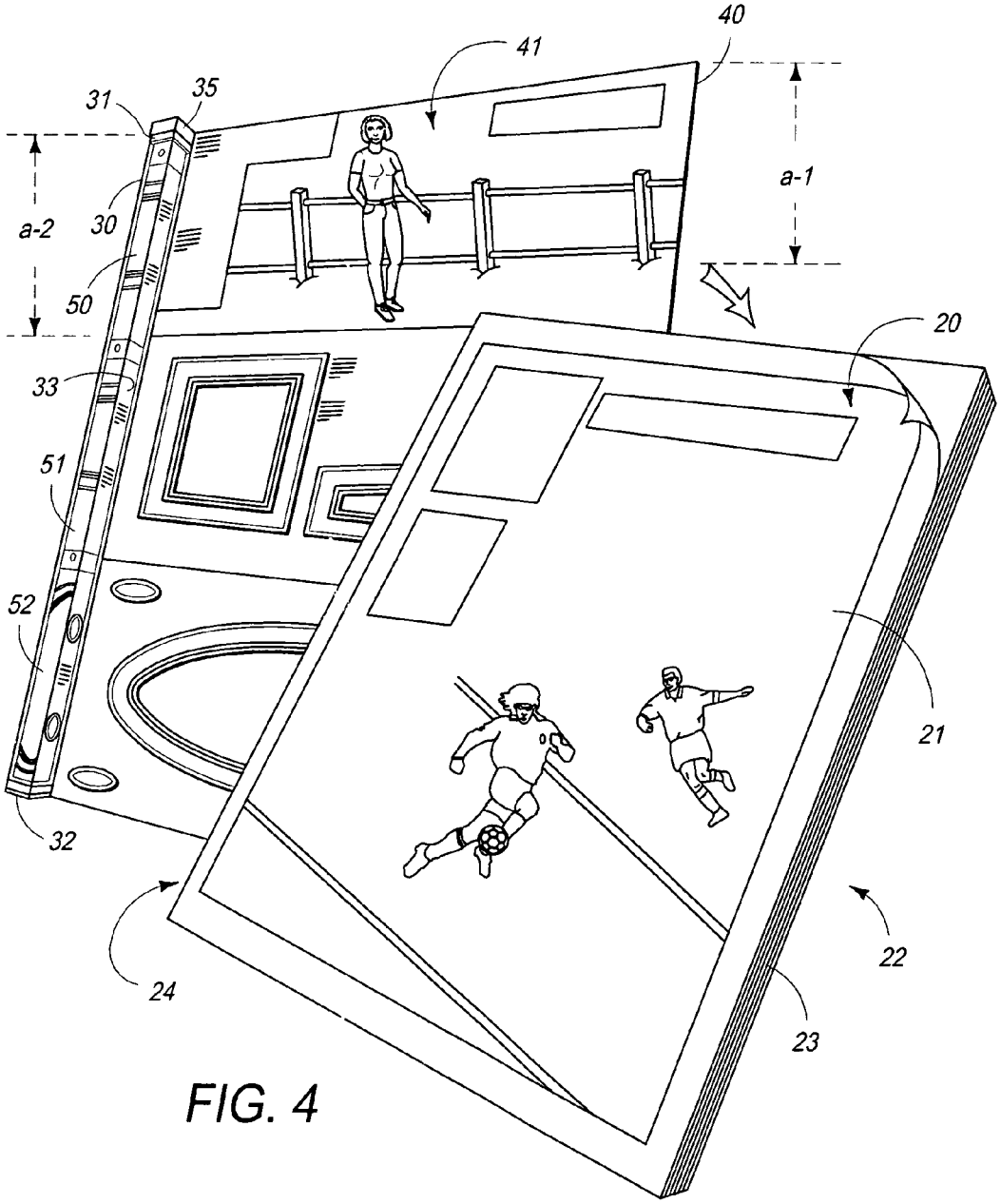
FIG. 4 is a perspective view drawing of the first preferred embodiment of the publication package appearing in FIG. 1, viewed from the front cover side, in which the outer package container, with attached backing, has been partially separated from the selected publication.

In FIG. 4, the first embodiment of publication package 10 of the present invention shown in FIG. 1 appears again in perspective, again without shrink-wrap covering means, which has been removed by the consumer. In FIG. 4, selected publication 20 is no longer attached to outer package container 30 of publication package 10, and selected publication 20 has been separated from outer package container 30 by pulling spine edge 24 of selected publication 20 away from first generally flat side 33 of outer package container 30. Again we may see in FIG. 4 selected publication 20 front cover 21, selected publication 20 page opening edge 22, and edges of individual pages 23 of selected publication 20. Again outer package container 30 is seen as a regular, tubular shape, with outer package container 30 top end 31 and outer package container 30 bottom end 32. Since selected publication 20 has been separated from outer package container 30, we may see in FIG. 4 first generally flat side 33 of outer package container 30 is no longer positioned against spine edge 24 of selected publication 20, and second generally flat side (not shown) of outer package container 30 affixed to backing 40.

Of particular importance in FIG. 4, as backing 40 is no longer positioned against the back cover of selected publication 20, we may for the first time see text and graphics (collectively the "Front Indicia") arrayed on the front side 41 of backing 40. The Front Indicia is broken into sections over the area of front side 41 in this embodiment in such a way as to enhance the marketing impact for consumers who purchase selected publication 20. This is accomplished through (I) the choice of materials from which backing 40 is formed, and through (ii) coordination of Indicia appearing on front side 41 with similar text and graphics on the exterior of inner package container 50 through 52, as viewed by a consumer through the clear plastic from which outer package container 30 is formed. Thus, and referring specifically to the choice of materials, backing 40 may be formed of high quality material, most suitable for printing high quality images and texts as Front Indicia, in ways which create exceptional, one-of-a-kind advertising impact. Such materials include card stock of various thickness and finish, but such materials may also include clear and opaque plastic of suitable rigidity, or even of metal, and slick plastic or metallic finishes. So long as these materials and finishes are chosen for their suitability of high-quality printing, or their transparency in the case of partial printing of a page, the Front Indicia may be of arbitrarily high quality, and resultant attractiveness.

As to the coordination of Indicia appearing on front side 41 of backing 40, the Front Indicia may be broken into sections on backing 40, and those sections coordinated with similar text and graphics on the exterior of inner package container 50, inner package container 51 and inner package container 52, as viewed by a consumer through the clear plastic from which outer package container 30 is formed, or when viewed by a consumer when outer package container 30 and backing 40 are separated from selected publication 20. More specifically, when outer package container 30 and backing 40 are first separated from selected publication 20, a consumer or subscriber is exposed to Front Indicia on front 41 of backing 40, much as she would be exposed to front 21 of selected publication 20 (and often at the same time). This allows the Indicia on front 41 of backing 40 to lead the consumer's eyes from Front Indicia on front 41 naturally to outer package container 30 and, because inner package container 50 through 52 may be viewed through the clear plastic of outer package container 30, to the similar indicia on the exterior surfaces of inner package container 50, inner package container 51, and inner package container 52. The Front Indicia on front 41 of backing 40 may be coordinated with the similar inner package container indicia on the exterior surfaces of inner package container 50 through 52, using similarity in colors and line, and using consistent trademark presentation, through similar or complimentary "look and feel," and by other means.

In this preferred embodiment of the publication package 10 of the present invention, for example, backing 40 Front Indicia appearing in FIG. 4 is broken into sections "a-1" and "b-1" and "c-1," with the borders of these sections running horizontally from outer package container 30 to backing 40 edge most distant from outer package container 30 when outer package container 30 is affixed to backing 40 during manufacture. The width of sections "a-1" through "c-1" in this embodiment as these sections run across the width of backing 40 (for clarity, only section "a" is marked in FIG. 4) may be printed to correspond to the length of each of inner package container 50 and inner package container 51 and inner package container 52 contained in outer package container 30, and the Front Indicia on front 41 of backing 40 may correspond to the same or similar text and images which have been printed on the exterior of inner package container 50 and inner package container 51 and inner package container 52, along their length at sections "a-2" and "b-2" and "c-2" (for clarity, only section "a-2" marked in FIG. 4). Accordingly, when selected publication 20 is separated from outer package container 30, and pulled away from front 41 of backing 40, the eye of the consumer may be attracted to the high impact images of the Front Indicia on front 41 of backing 40, and that eye may linger over such Front Indicia, and induce that consumer to open outer package container 30, remove inner package container 50 and inner package container 51 and inner package container 52 containing product samples, and try each of the product samples contained in inner package container 50 and inner package container 51 and inner package container 52.

Figure 5:
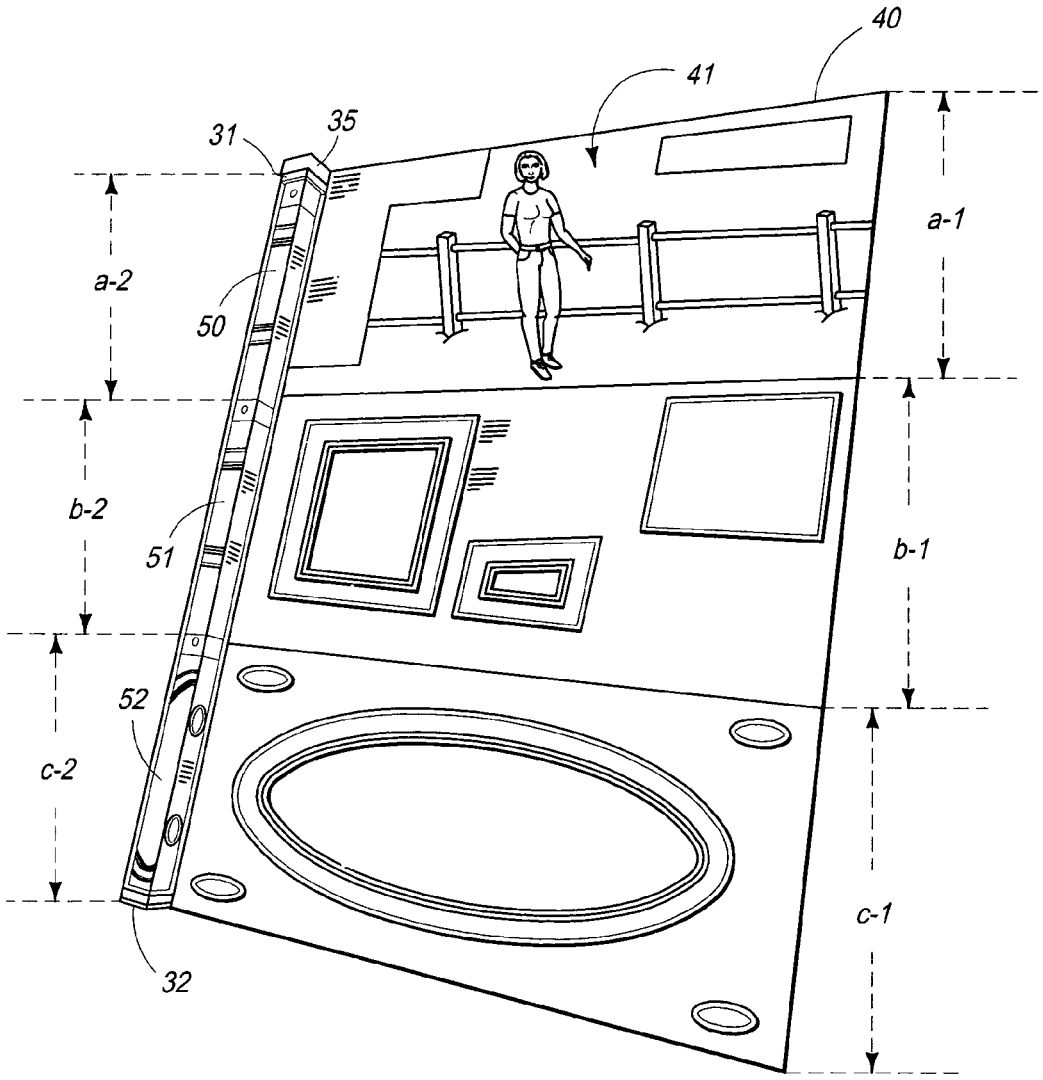
FIG. 5 is a perspective view drawing of the first preferred embodiment of the publication package appearing in FIG. 1, viewed from the front, in which the outer package container, with attached backing, has been fully separated from the selected publication.

In FIG. 5, the first embodiment of publication package 10 of the present invention shown in FIG. 1 appears again in perspective, again without shrink-wrap covering means and, in FIG. 5, also without selected publication 20. Again outer package container 30 is seen as a regular, tubular shape, with outer package container 30 top end 31 and outer package container 30 bottom end 32. In FIG. 5, we may again see the Front Indicia arrayed on front side 41 of backing 40, and again the Front Indicia is broken into sections over the area of front side 41 in such a way as to enhance the marketing impact for consumers who purchase selected publication 20. Focusing specifically on the coordination of Front Indicia appearing on front side 41 of backing 40, the Front Indicia of FIG. 5 is broken into three sections on backing 40, and those sections are coordinated with similar text and graphics on the exterior of inner package container 50 and inner package container 51 and inner package container 52. In this preferred embodiment of the publication package 10 of the present invention, backing 40 Front Indicia is broken into three sections "a-1" and "b-1" and "c-1," with the borders of these sections running horizontally from outer package container 30 to backing 40 edge most distant from outer package container 30 when outer package container 30 is affixed to backing 40 during manufacture. The width of sections "a-1" through "c-1" in this embodiment are now printed to correspond to the length of each corresponding inner package container 50 and inner package container 51 and inner package container 52, each of which are still contained within outer package container 30. Also, the Front Indicia on front 41 of backing 40 corresponds to the same or similar text and images which have been printed on the exterior of inner package container 50 through 52 along their length. Thus the width of section a-1 corresponds with the length of inner package container 50 within section a-2 of outer package container 30, the width of section b-1 corresponds with the length of inner package container 51 within section b-2 of outer package container 30, and the width of section c-1 corresponds with the length of inner package container 52 within section c-2 of outer package container 30.

Figure 6:
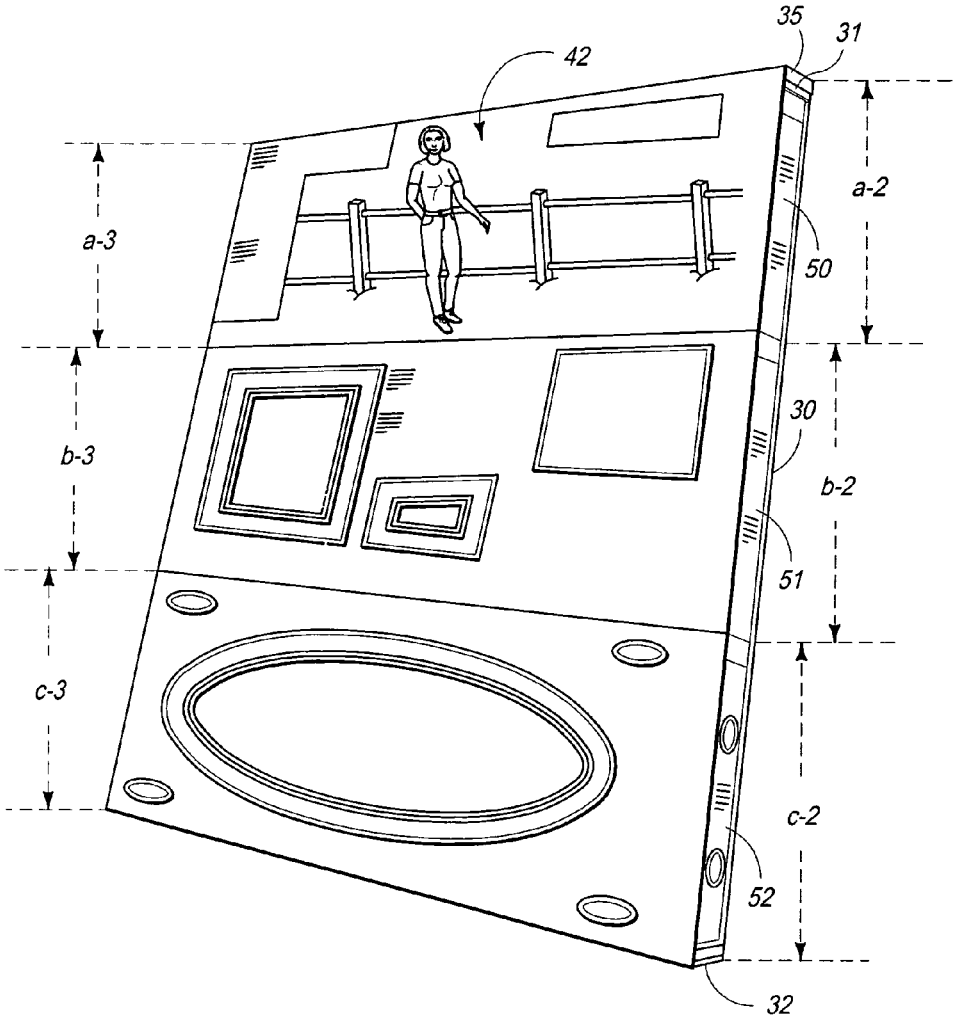
FIG. 6 is a perspective view drawing of the first preferred embodiment of the publication package appearing in FIG. 1, viewed from the back cover side, in which the outer package container, with attached backing, has been fully separated from the selected publication.

In FIG. 6, the first embodiment of publication package 10 of the present invention shown in FIG. 1 appears again in perspective, again without shrink-wrap covering means, which has been removed by the consumer. Again, publication package 10 is also shown without selected publication 20. FIG. 6 again shows outer package container 30 as a regular, tubular shape, with outer package container 30 top end 31 and outer package container 30 bottom end 32. In FIG. 6, however, we may now see the Back Indicia, which is arrayed on the back side 42 of backing 40, and again the Back Indicia is broken into sections over the area of back side 42 in such a way as to enhance the marketing impact for consumers who purchase selected publication 20. Focusing specifically on the coordination of Back Indicia appearing on back side 42 of backing 40, the Back Indicia of FIG. 6 is again broken into three sections on backing 40, and those sections are again coordinated with similar text and graphics on the exterior of each of inner package container 50, inner package container 51 and inner package container 52, as viewed by a consumer through the clear plastic from which outer package container 30 is formed. In this preferred embodiment of the publication package 10 of the present invention, backing 40 Back Indicia is again broken into three sections "a-3" and "b-3" and "c-3," with the borders of these sections running horizontally from outer package container 30 to backing 40 edge most distant from outer package container 30 when outer package container 30 is affixed to backing 40 during manufacture. The width of sections "a-3" through "c-3" in this embodiment are now again printed to correspond to the length of each of three inner package containers 50 through 52 contained in outer package container 30 in this embodiment. Also, the Back Indicia of back 42 of backing 40 correspond to the same or similar text and images which have been printed on the exterior of inner package container 50 and inner package container 51 and inner package container 52 along their length at sections "a-2" and "b-2" and "c-2."

Figure 7:
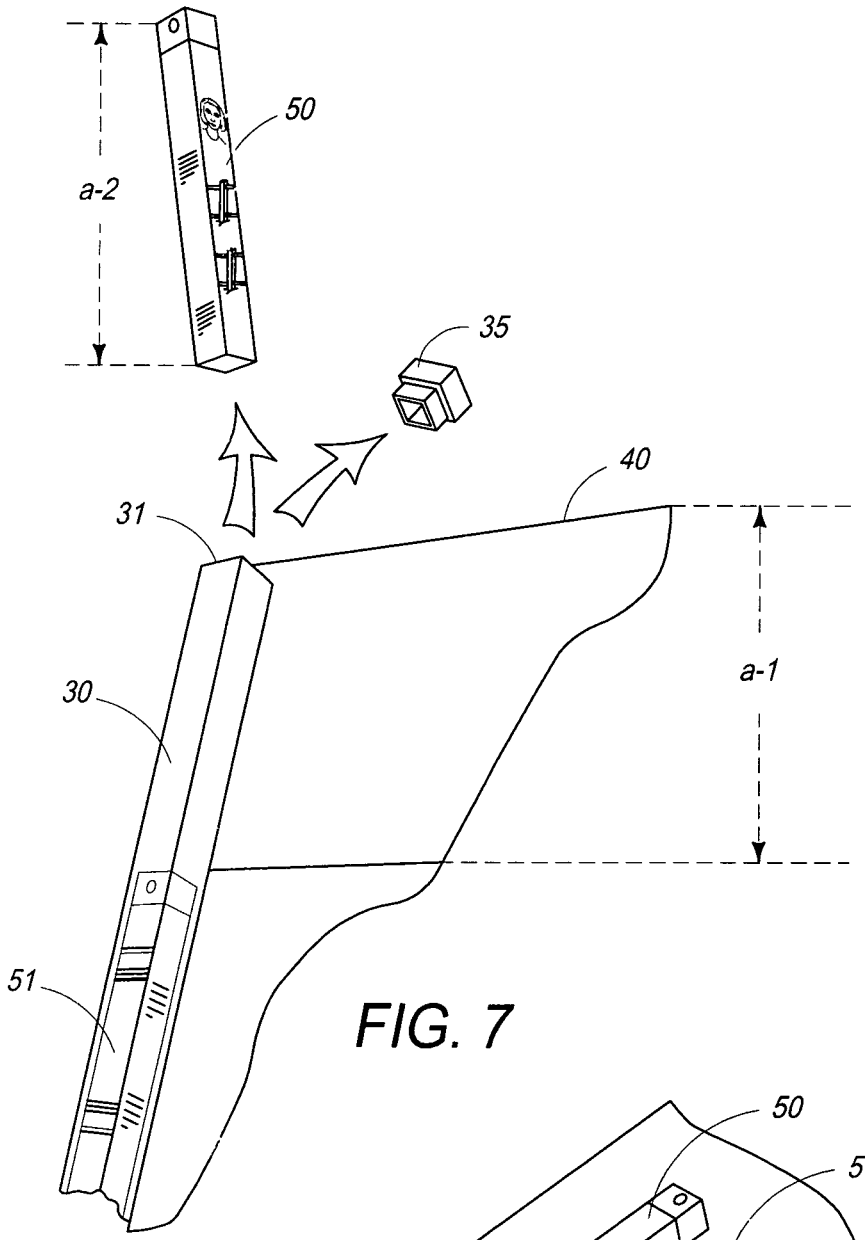
FIG. 7 is a perspective view drawing of the first preferred embodiment of the publication package appearing in FIG. 1, viewed from the front cover side, in which the closure means of the outer package container has been removed from the top end of the outer package container, and one inner package container has been removed from the same top end of the outer package container.
Figure 8:
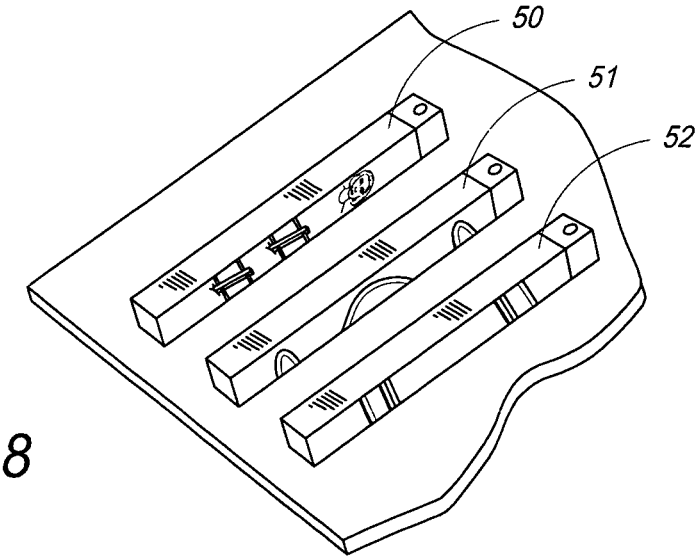
FIG. 8 is a perspective view drawing of three inner package containers of the first preferred embodiment of the publication package appearing in FIG. 1, after the closure means of the outer package container and all inner package containers have been removed from the now open end of the outer package container, and all inner package containers are in condition for use.

In FIG. 7, a portion of the first embodiment of the publication package 10 of the present invention shown in FIG. 1 appears again in perspective, again without shrink-wrap which has been removed by the consumer. Outer package container 30 is again seen as a regular, tubular shape, however only outer package container 30 top end 31 appears in FIG. 7, along with some of the length of outer package container 30, and portions of sections "a-1" and "b-1" of backing 40. For clarity, the Front Indicia shown in FIG. 5 has been removed from FIG. 7. Also inner package container 50, which may be viewed by a consumer through the clear plastic of outer package container 30 up until this point, has now been removed from outer package container 30, and is ready to be used by a consumer. In this particular example, inner package container 50 is a fragrance applicator, with spray top, by which the consumer may deploy the fragrance. Inner package container 50 can be removed from outer package container 30 by simply turning the top end 31 of outer package container 30 downward, and allowing inner package container 50 to slide out of outer package container 30. In a similar way, inner package container 51 and inner package container 52 may be removed from outer package container 30 after first removing inner package container 50. Once inner package container 50 and inner package container 51 and inner package container 52 have each been removed from outer package container 30, all inner package containers are then available for use by the consumer as seen in FIG. 8. Of course, the number of inner package containers which may be contained in outer package container 30 is limited only by the length of each inner package container, and by the length of outer package container. Accordingly, a publisher or manufacturer may place a single inner package container within outer package container 30 for delivery to a consumer, or dozens of inner package containers may be placed within outer package container 30 for delivery.

Other embodiments will be apparent to those skilled in the art from consideration of the specification and practice of the invention disclosed herein. It is intended that the specification and examples be considered as exemplary only, with a true scope of the invention being indicated by the following claims and equivalents.

What is claimed is:

1. A publication package comprising:

a selected publication having pages which join along a spine, the pages having four pages edges around their periphery, an outer package container, formed of clear material in a generally tubular shape, with top end and bottom end, a first generally flat side, and a second generally flat side, a generally flat backing having a front side and a back side, and four backing edges around its periphery, the generally flat backing formed of resilient material rigid enough to resist folding, the generally flat backing having a length approximately as long as the outer package container, the generally flat backing having a width approximately as wide as the pages of the selected publication, the generally flat backing is affixed to the second generally flat side of the outer package container, the selected publication is positioned on the generally flat backing so that the four publication page edges are approximately aligned to the corresponding four backing edges, and the publication spine is situated next to the second generally flat side of the outer package container, a covering means which encloses the selected publication, the outer package container, and the generally flat backing.

2. The publication package of claim 1 further comprising a closure means closing the bottom end of the outer package container.

3. The publication package of claim 2 further comprising a closure means which may be fitted to the top end of the outer package container to close the top end of the outer package container.

4. The publication package of claim 1 further comprising a first closure means which may be fitted to the top end of the outer package container, to close the top end of the outer package container, and a second closure means which may be fitted to the bottom end of the outer package container, to close the bottom end of the outer package container.

5. The publication package of claim 1 further comprising front indicia printed on the front side of the backing.

6. The publication package of claim 1 further comprising back indicia printed on the back side of the backing.

7. The publication package of claim 1 further comprising at least one inner package container, formed to fit within the outer package container.

8. The publication package of claim 7 in which the least one inner package container in impressed with indicia which is coordinated with front indicia printed on the front side of the backing.

9. The publication package of claim 3 in which the at least one inner package container is placed within the outer package container, and the closure means is fitted to the top end of the outer package container to close the top end of the outer package container.

10. The publication package of claim 8 further comprising front indicia printed on the front side of the backing.

11. The publication package of claim 8 further comprising back indicia printed on the back side of the backing.

12. The publication package of claim 9 further comprising back indicia printed on the back side of the backing.

* * * * *